US009568929B2

(12) United States Patent
Eberlein

(10) Patent No.: US 9,568,929 B2
(45) Date of Patent: Feb. 14, 2017

(54) BANDGAP REFERENCE CIRCUIT WITH BETA-COMPENSATION

(71) Applicant: INTEL CORPORATION, Santa Clara, CA (US)

(72) Inventor: Matthias Eberlein, Holzkirchen (DE)

(73) Assignee: INTEL CORPORATION, Santa Clara, CA (US)

( * ) Notice: Subject to any disclaimer, the term of this patent is extended or adjusted under 35 U.S.C. 154(b) by 140 days.

(21) Appl. No.: 14/444,890

(22) Filed: Jul. 28, 2014

(65) Prior Publication Data

US 2016/0026198 A1 Jan. 28, 2016

(51) Int. Cl.
*G05F 1/575* (2006.01)

(52) U.S. Cl.
CPC ..... *G05F 1/575* (2013.01)

(58) Field of Classification Search
CPC ..... G05F 1/00; G05F 1/10; G05F 1/45; G05F 1/575; G05F 3/00; G05F 3/20; G05F 3/205; G05F 3/22; G05F 3/222; G05F 3/225; G05F 3/242; G05F 3/245; G05F 3/262; G05F 3/265; G05F 3/267; G05F 3/30; G11C 5/00; G11C 5/147
USPC ..... 327/538, 539, 540, 543; 323/313
See application file for complete search history.

(56) References Cited

U.S. PATENT DOCUMENTS 5,900,772 A 5/1999 Somerville et al.
8,021,042 B1 * 9/2011 Aslan ..... G01K 7/015 327/512
9,141,124 B1 * 9/2015 Nien ..... G05F 3/30

OTHER PUBLICATIONS

Fayomi et al., "Sub 1 V CMOS bandgap reference design techniques: a survey" Analog Integrated Circuits, Springer Science+Business Media, LLC, 2009.

* cited by examiner

*Primary Examiner* — John Poos
*Assistant Examiner* — David Mattison
(74) *Attorney, Agent, or Firm* — Schwabe, Williamson & Wyatt, P.C.

(57) ABSTRACT

Described are apparatuses and methods for generating a temperature-stabilized reference voltage on a semiconductor chip. An apparatus may include a differential amplifier including a first input, a second input, and an output. The apparatus may further include a first bipolar junction transistor (BJT) coupled to the first input; a second BJT coupled to the second input; and beta compensation circuitry, coupled to the first BJT and the second BJT, to regulate a first collector current of the first BJT to be independent of a first current gain of the first BJT and a second collector current of the second BJT to be independent of a second current gain of the second BJT. Other embodiments may be described and/or claimed.

16 Claims, 5 Drawing Sheets

BANDGAP REFERENCE CIRCUIT WITH BETA-COMPENSATION

TECHNICAL FIELD

This disclosure relates generally to electronic circuits. More particularly but not exclusively, the present disclosure relates to apparatuses and methods for generating a reference voltage on a semiconductor chip.

BACKGROUND

Semiconductor bandgap voltage reference (BVR) circuits are used as voltage references for operating voltages in analog, digital, and mixed analog-digital circuits. For example, an accurate voltage reference is needed in almost any system on chip (SoC). Conventional BVR circuits operate on the principle of the addition of two partial voltages with opposite temperature responses. While one partial voltage rises proportionately with the absolute temperature (PTAT partial voltage, also referred to as "proportional to absolute temperature"), the other partial voltage falls as the temperature rises (CTAT partial voltage, also referred to as "complementary to absolute temperature"). An output voltage with low sensitivity to temperature is obtained as the sum of these two partial voltages.

With the development of ever-smaller microprocessors and memory cells, such as microprocessors and memory cells based on multiple gate field-effect transistors (MuGFET) and further process scaling, bipolar devices (e.g., bipolar junction transistor (BJT)) used in conventional BVR circuits have shown drastic degradation in reliability, particularly when the current-gain (β) of a BJT is low, e.g., less than three.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
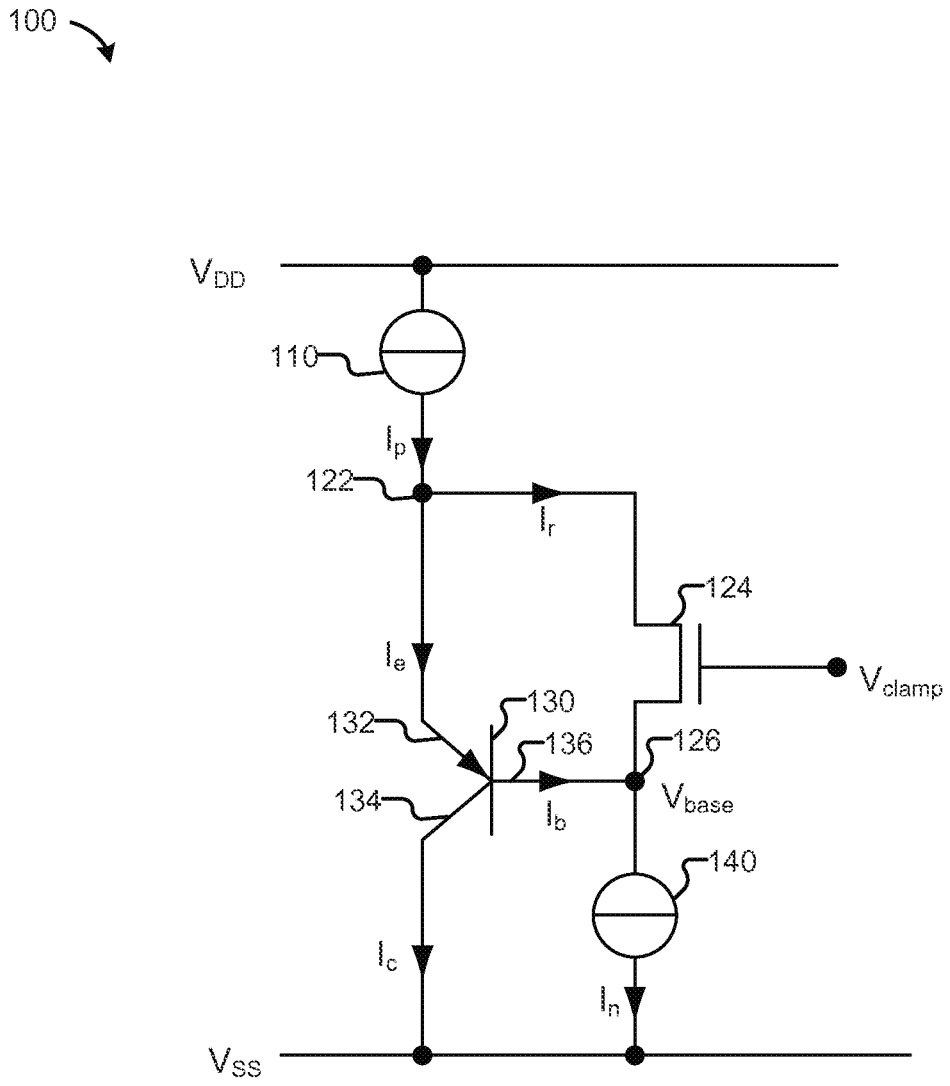
FIG. 1 is a schematic diagram of an example circuit for current regulation, incorporating aspects of the present disclosure, in accordance with various embodiments.

The embodiments described herein include apparatuses and methods for generating a temperature-stabilized reference voltage on a semiconductor chip. In one embodiment, an apparatus may include a differential amplifier having a first input, a second input, and an output. The apparatus may further include a first BJT coupled to the first input, a second BJT coupled to the second input; and β-compensation circuitry, coupled to the first BJT and the second BJT, to regulate a first collector current of the first BJT to be independent of a first current gain of the first BJT and a second collector current of the second BJT to be independent of a second current gain of the second BJT. These embodiments will be described in more detail below. Other technical effects will also be evident from the descriptions to follow.

In the following description, numerous details are discussed to provide a more thorough explanation of embodiments of the present disclosure. It will be apparent, however, to one skilled in the art, that embodiments of the present disclosure may be practiced without these specific details. In other instances, well-known structures and devices are shown in block diagram form, rather than in detail, in order to avoid obscuring embodiments of the present disclosure.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Throughout the specification, and in the claims, the term "connected" means a direct electrical connection between the things that are connected, without any intermediary devices. The term "coupled" means either a direct electrical connection between the things that are connected or an indirect connection through one or more passive or active intermediary devices. The term "circuit" means one or more passive and/or active components that are arranged to cooperate with one another to provide a desired function. The term "signal" means at least one current signal, voltage signal, or data/clock signal. The meaning of "a," "an," and "the" include plural references. The meaning of "in" includes "in" and "on."

The terms "substantially," "close," "approximately," "near," and "about" generally refer to being within +/−20% of a target value. The term "scaling" generally refers to converting a design (schematic and layout) from one process technology to another process technology. The term "scaling" generally also refers to downsizing layout and devices within the same technology node. The term "scaling" may also refer to adjusting (e.g., slowing down) a signal frequency relative to another parameter, for example, power supply level.

Unless otherwise specified, the use of the ordinal adjectives "first," "second," "third," etc., to describe a common object merely indicate that different instances of like objects are being referred to, and are not intended to imply that the objects so described must be in a given sequence, either temporally, spatially, in ranking, or in any other manner.

For purposes of the embodiments, bipolar junction transistors (BJTs) are used in many embodiments, which include emitter, base, and collector terminals. Those skilled in the art will appreciate that other p-type devices may be used without departing from the scope of the disclosure. For purposes of the embodiments, metal oxide semiconductor (MOS) transistors, which include drain, source, gate, and bulk terminals, are used in various embodiments. Those skilled in the art will appreciate that other transistors, such as Tri-Gate transistors and Fin-Shaped Field Effect Transistors (FinFet), Gate All Around Cylindrical Transistors, or other devices implementing transistor functionality, like carbon nano tubes or spintronic devices, may be used without departing from the scope of the disclosure. In various embodiments, source and drain terminals may be identical terminals and are interchangeably used herein. For purposes of the embodiments, the term "MN" indicates an n-type transistor (e.g., NMOS, NPN BJT, etc.), and the term "MP" indicates a p-type transistor (e.g., PMOS, PNP BJT, etc.).

In a conventional bandgap voltage reference circuit, bandgap references may be built by combining voltages (or currents) with positive and negative temperature coefficients, i.e., one voltage proportional to absolute temperature (PTAT) and the other complementary to absolute temperature (CTAT). For example, a bandgap reference voltage (Vref) may follow equation 1.

$$Vref = Vptat + Vctat \tag{1}$$

If the two voltages, Vptat and Vctat, are chosen properly, the first order effects of the temperature dependency of the two voltages will cancel out, thus producing a temperature-stabilized reference voltage.

A complementary metal-oxide-semiconductor (CMOS) bandgap voltage reference circuit may yield:

$$Vctat = Vbe \tag{2}$$

$$Vptat = k \cdot \Delta Vbe = k \cdot Vt \cdot \ln(N) \tag{3}$$

$$Vref = Vptat + Vctat = k \cdot Vt \cdot \ln(N) + Vbe \tag{4}$$

In the above equations, Vbe is the base-emitter voltage drop of one of the two bipolar devices ($Q_1$ and $Q_2$) in the CMOS bandgap voltage reference circuit, while ΔVbe is the difference of base-emitter voltages of the two bipolar devices. k is a multiplication factor, and Vt is a thermal voltage. N is a constant ratio of current densities between the two bipolar devices.

Generally, the PTAT part is generated through rationed biasing of the two bipolar devices $Q_1$ and $Q_2$. $Q_1$ and $Q_2$ may be BJT transistors, which relate the Vbe voltage to the collector current (Ic), thus a bandgap becomes β-dependent as shown below.

$$Ic = Is \cdot e^{Vbe/Vt} = \frac{Ie}{(1 + 1/\beta)} \tag{5}$$

$$Vbe = \ln\left(\frac{Ic}{Is}\right) \cdot Vt = \ln\left(\frac{Ie}{(1 + 1/\beta)Is}\right) \cdot Vt \tag{6}$$

In the above equations, Is is the saturation current, and Ie is the emitter current. The conventional bandgap circuit may produce an accurate bandgap reference voltage when the influence of the current gain of these two bipolar devices is negligible. The influence of the current gain may be negligible if their current gains are very large or at least it is predictable in terms of their ratio so that the collector current may be controlled by the emitter current. For example, for large β-values (e.g., β>>5), the impact of β on Vbe may be negligible due to the logarithmic relationship in the above equation. Moreover, it is generally assumed that $Q_1$ has the same current gain as $Q_2$, and the connector currents from $Q_1$ and $Q_2$ are the same. Thus, different current densities between $Q_1$ and $Q_2$ may produce the 4 Vbe needed for the PTAT voltage (Vptat).

However, low current gains in new processes (e.g., β=0.5 . . . 3) will result in an unstable and inaccurate bandgap reference in circuit 100. When the current gain is very low and with relative significant variations, the collector currents from $Q_1$ and $Q_2$ may not be made equal by controlling their respective emitter currents.

ΔVbe may become unstable with an unstable ratio of current densities between $Q_1$ and $Q_2$. The ratio N in equation 3 or 4 is assumed to be constant. The ratio N may depend on various factors, such as temperature, absolute current value, and of course the processes. Moreover, β-variation, e.g., caused by temperature, may induce the ratio N to vary with temperature. Furthermore, a low β value may further deteriorate the variation of the ratio N. Thus, the ratio N may be unstable with low β values. When the β-ratio is unknown and not accurately determined, the collector current ratio cannot be determined. As an example, when the current gain is lower than 1, e.g., 0.5, a β-mismatch between $Q_1$ and $Q_2$ may result in a large difference of the collector currents between $Q_1$ and $Q_2$. Consequently, the PTAT part of the bandgap cannot be generated accurately, thus the bandgap becomes less accurate.

Additionally, the CTAT part (e.g., Vbe in equation 2) for Vref may also become unstable or unpredictable because the effective collector current also varies with the process spread of β. Further, curvature of Vbe may be changed due to the impact of the β-temperature characteristic on the amplitude of the collector current. For at least the above discussed issues, conventional bandgap voltage reference circuits may not be able to produce accurate bandgap reference with low current gains in new processes because the PTAT and CTAT in a standard bandgap are sensitive to β-mismatch as well as to low β value, e.g., when β is below 1.

FIG. 1 is a schematic diagram of an example circuit for current regulation, incorporating aspects of the present disclosure, in accordance with various embodiments. In various embodiments, circuit 100 may include current sources 110 and 140 coupled to transistor 130. In some embodiments, transistor 130 may be a BJT. In various embodiments, a feedback loop in circuit 100, e.g., including base 136, node 126, separating device 124, node 122, and emitter 132, may regulate the collector current Ic from collector 134 independent of the current gain (β) of transistor 130.

In various embodiments, circuit 100 may compensate the impact of β by adjusting a corrective current to emitter 132 based on the sensed base current Ib at base 136. Circuit 100 is biased by two distinctive currents Ip and In, coupled to current sources 110 and 140 respectively, e.g., Ip may be supplied to emitter 132 while In may draw current from base 136. Ip and In are known control currents in circuit 100. Ip and In may define the effective collector current (Ic) from collector 134. In some embodiments, current sources 110 and 140 may be fixed current sources, which provide fixed currents with Ip and In.

In various embodiments, the feedback loop in circuit 100 may include two paths for currents. Node 122 may be connected to current source 110, and splits current Ip onto two paths, current Ie to transistor 130 and current Ir to separating device 124. On the other side, node 126 may be connected to current source 140, and converges current Ir and base current Ib from base 136.

In various embodiments, base current Ib may be sensed at node 126, for example, by comparing Ib to In. Separating device 124 may separate node 122 from node 126, and clamp the voltage (Vbase) at node 126. Here, Vbase may not be equal to ground, but is at a level controlled by the voltage Vclamp coupled to separating device 124. In one embodiment, separating device 124 may be an N-type metal-oxide-semiconductor field-effect transistor (NMOS) transistor.

Specifically, the various currents in circuit 100 may be related with the following equations.

$$Ir = In - Ib = In - \frac{Ic}{\beta} \tag{7}$$

In equation 7, current In is the sum of current Ir and current Ib. Further, current Ib is related to current Ic based on the current gain (β) of transistor 130.

$$Ie = Ip - Ir = Ip - In + \frac{Ic}{\beta} \tag{8}$$

In equation 8, Ir is derived from equation 7. Current Ip is the sum of current Ie and current Ir. In other words, current Ie is subtracted from current Ip. Therefore, change of Ir will cause corresponding change of Ie. Further, current Ie is also related to the current gain (β) based on equation 8 above.

$$Ie = Ic + Ib = Ic + \frac{Ic}{\beta} \tag{9}$$

In equation 9, current Ie may also be expressed as the sum of current Ic and Ib wherein Ib may be further expressed based on β.

$$Ic = Ip - In \tag{10}$$

Equation 10 may then be derived from equations 8 and 9. Equation 10 indicates that collector current Ic may be regulated by current Ip and current In, and becomes independent of the current gain of transistor 130. In various embodiments, when Ip and In are constant, the collector current Ic may also be regulated to be constant. In some embodiments, the absolute values of Ip and In may be chosen according to the lowest β-value expected, making Ir approach zero. As an example, for β of 0.5 and a targeted value for Ic, one may choose Ip to be three times Ic and In to be two times Ic according to equation 11 below.

$$Ir = In - \frac{Ic}{0.5} == 0; \Rightarrow In = 2 \cdot Ic;\ Ip = 3 \cdot Ic \tag{11}$$

In various embodiments, the collector current of a transistor may be regulated to be independent of the current gain of the transistor. As an example, the base current Ib may be sensed at node 126, then current Ir may be regulated accordingly per equation 7 above. The adjusted current Ir becomes the feedback for current Ie to be regulated per equation 8. As an example, if base current Ib increases, current Ir will decrease since In is a constant current. Then, current Ie will increase because it is the subtraction of Ip and Ir. Vice versa, if base current Ib decreases, Ir will increase, and Ie will decrease.

In this way, circuit 100 has a built-in regulating function with the feedback loop to ensure the synchronized movement of Ib and Ie, so that collector current Ic may be kept independent of β, or kept constant in some embodiments. As a result, any error from base current Ib may be corrected, and the collector current Ic may be regulated independent of the current gain of the transistor. In some embodiments, collector current Ic may be kept constant regardless of the current gain of transistor 130 or the fluctuation of base current Ib. Since the collector current of a transistor may be regulated to be independent of the current gain of the transistor, transistors with low current gains, e.g., β below 3 or even below 1, may function properly in applications depending on the collector current or whenever the current gain should be compensated. As an example, the collector of a parasitic p-type device in a bandgap reference circuit may not be accessed directly, but by applying the principle discussed above, the collector current of such parasitic p-type device may still be regulated through the emitter.

The design principle of circuit 100 may be applied in many other applications. A temperature sensor is one such application. Thermal sensors normally utilize the temperature characteristics of a bipolar device. Temperature sensors also suffer from the fact that the behavior of the bipolar device may become unpredictable if the current gain of the bipolar device is too low. The design principle of circuit 100 may then be applied to those applications to ensure that the current gain is compensated, and the behavior of the bipolar device remains stable.

Figure 2:
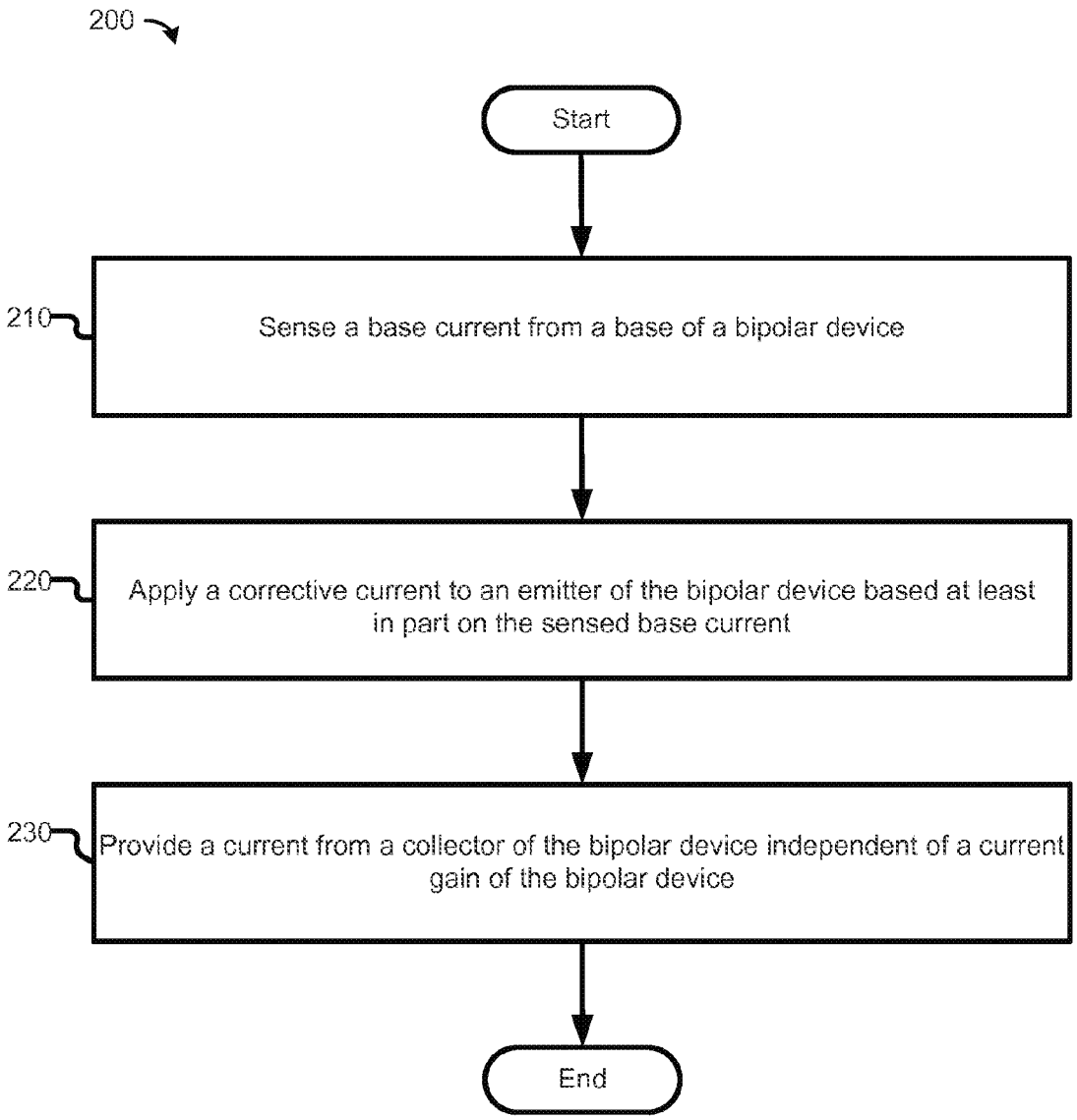
FIG. 2 is a flow diagram of an example current regulation process executable by an example apparatus incorporating aspects of the present disclosure, in accordance with various embodiments.

FIG. 2 is a flow diagram of an example current regulation process incorporating aspects of the present disclosure, according to various embodiments. As shown, process 200 may be performed by a circuit utilizing the design principal as disclosed in FIG. 1 to implement one or more embodiments of the present disclosure.

In embodiments, at block 210 of process 200, a base current from a base of a bipolar device may be sensed. As an example, the base current Ib may be sensed at node 126 in circuit 100 by comparing Ib to In.

Next, at block 220, a corrective current based at least in part on the sensed base current may be applied to an emitter of the bipolar device. As an example, the feedback loop in circuit 100 may provide a regulating function, which regulates a synchronized change of Ib and Ie. In this case, the sensed base current may stimulate a change with Ir, in turn causing a corrective current to be applied to emitter 132.

In applying the corrective current, first and second fixed currents, e.g., Ip and In, may be applied to a feedback loop between emitter 132 and base 136. In embodiments, the first fixed current, e.g., Ip, may be split onto a first path and a second path of the feedback loop. The first path may include emitter 132. The second path may include base 136. The current Ir on the second path may be adjusted based on the sensed base current Ib. Subsequently, the corrective current may be applied to emitter 132 based on the current on the second path Ir and the first fixed current Ip.

Next, at block 230, a collector current from a collector of the bipolar device may be provided independent of a current gain of the bipolar device. The corrective current applied at block 230 may compensate for the current gain of the bipolar device, thus enabling the collector current to be independent of the current gain. As an example, collector current k in circuit 100 may be regulated by Ip and In independent of the β of transistor 130. In those embodiments, when Ip and In are constant, the collector current of the bipolar device may also be regulated to be constant. Therefore, in various embodiments, the collector current may be produced to be equal to a difference between the first and second fixed currents Ip and In.

Figure 3:
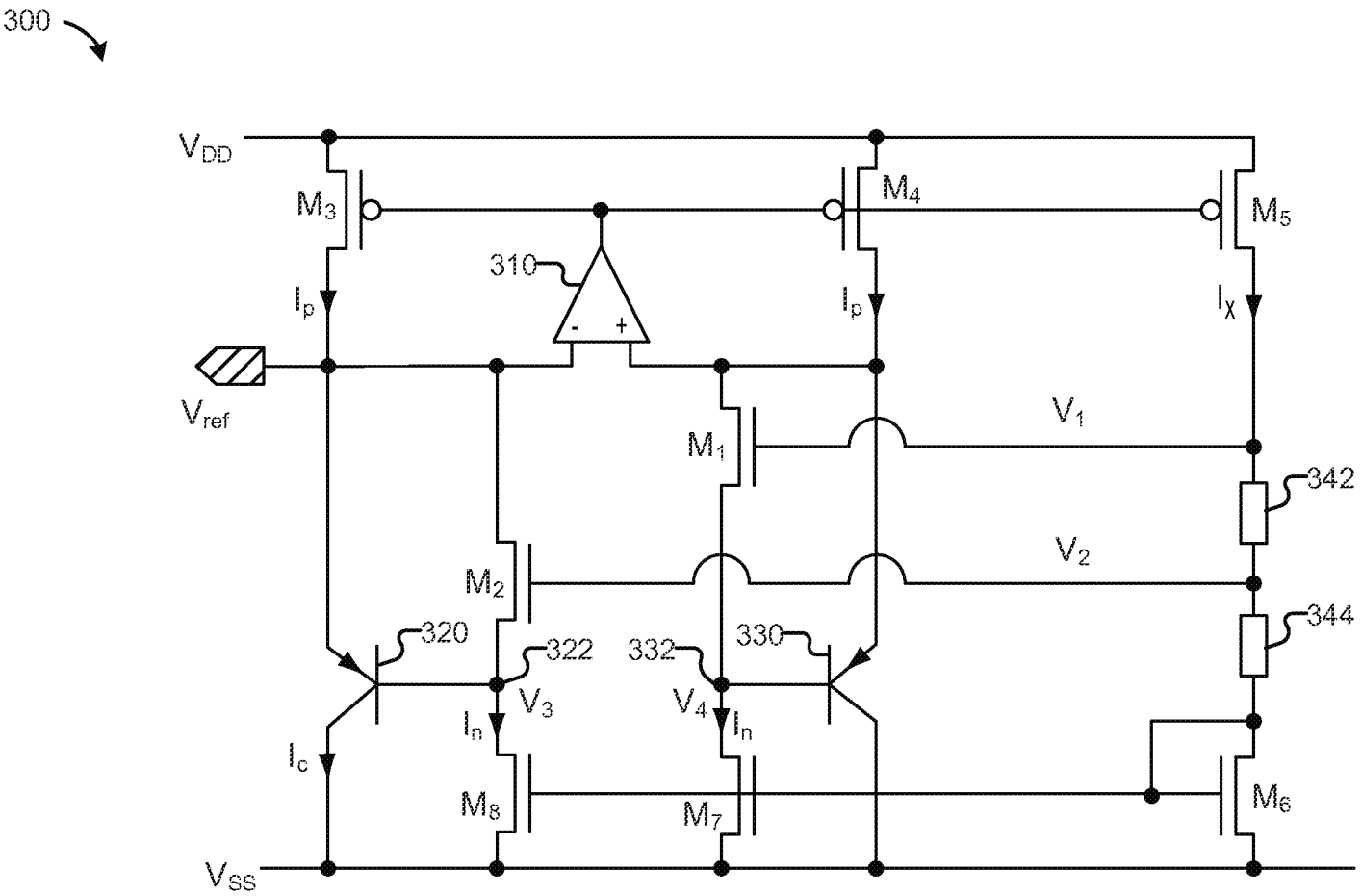
FIG. 3 is a schematic diagram of an example bandgap voltage reference circuit, incorporating aspects of the present disclosure, in accordance with various embodiments.

FIG. 3 is a schematic diagram of an example bandgap voltage reference circuit 300, incorporating aspects of the present disclosure, in accordance with various embodiments. Those elements of FIG. 3 having the same reference numbers (or names) as the elements of any other figure can operate or function in any manner similar to that described, but are not limited to such. So as not to obscure the embodiments, elements and features discussed previously may not be repeated.

In embodiments, Vref, a temperature-stabilized reference voltage, may be obtained from circuit 300. In order to establish a different base-emitter voltage, transistor 320 and transistor 330 may have an area-ratio of N:1 to have rationed biasing currents. In some embodiments, transistor 320 or 330 may be a BJT.

In various embodiments, amplifier 310 may keep the two emitter potentials of transistor 320 and transistor 330 at the same level, e.g., by self-biasing a current such that those two voltages may keep the same. In turn, currents from transistors M3 and M4 to respective emitters of transistor 320 and transistor 330 may be regulated to be equal, e.g., to Ip.

Amplifier 310 may also bias a feedback loop through transistor M5. Current Ix leaving $M_5$ may have a fixed ratio to current Ip. This feedback loop may be closed by transistors $M_1$ and $M_2$, which enables clamping voltages $V_1$ and $V_2$ to regulate the respective voltages at nodes 322 and 332. In some embodiments, transistors $M_1$ and $M_2$ may be matched such that they may have the same threshold voltages.

The current created by amplifier 310 is the source of the PTAT voltage for Vref, and the PTAT voltage may be generated by voltages of $V_1$ and $V_2$. $V_1$ and $V_2$ are biased such that $V_1$ may be always higher than $V_2$. Devices $M_1$ and $M_2$ may be matched, so that they may exhibit similar voltage drop between their individual gate and source, respectively. In consequence, the same voltage difference of gate voltages $V_1$ and $V_2$ may appear also at the source as difference between $V_4$ and $V_3$, respectively. As a result, the PTAT voltage may be equal to the voltage drop over resistor 342, which equals the gate voltage biasing of $M_1$ and $M_2$, and also equals the difference between the voltages at nodes 322 and 332, as shown in equation 12.

$$\Delta Vbe = V4 - V3 \tag{12}$$

In connection with equation 3 or 4, resistor 344 may further generate the multiplication factor k, so that the PTAT voltage may be further regulated. Resistors 342 and 344, which are used to establish the PTAT voltages, are located in a separate circuit branch biased by transistor $M_5$ in circuit 300. The same circuit branch also creates the clamping voltages $V_1$ and $V_2$ at the gates of $M_1$ and $M_2$, respectively.

It may be understood that resistor 342 may regulate the difference of $V_1$ and $V_2$; resistor 344, on the other hand, may regulate the absolute value of $V_1$ and $V_2$. The ratio of resistor 344 and resistor 342 may be selected to scale the final bandgap voltage Vref.

In embodiments, resistors 342 and 344 may act like amplifiers as the same current flows through them. If the resistance $R_2$ of resistor 344 is larger than the resistance $R_1$ of resistor 342, the PTAT voltage may be multiplied by a factor of $R_2$ divided by $R_1$.

In some embodiments, the threshold voltage of transistor $M_6$ and transistor $M_2$ (or $M_1$) may be made equal, thus voltage $V_3$ at node 322 may follow equation 13.

$$V3 = Vptat \cdot K = Vptat \cdot \frac{R2}{R1} \tag{13}$$

Therefore, a reference voltage may be established at the emitter of transistor 320 or 330 as in equation 14, wherein ΔVbe is the difference of base-emitter voltages of the two transistors 320 and 330, $Vbe_{320}$ is the base-emitter voltage of transistor 320, Vt is a thermal voltage, and N is the constant ratio of current densities between transistors 320 and 330.

$$Vref = Vptat + Vctat = k \cdot \Delta Vbe + Vbe_{320} = V3 + Vbe_{320} = Vt \cdot \frac{R2}{R1} \cdot \ln(N) + Vbe_{320} \tag{14}$$

In circuit 300, transistor $M_6$ may be used with transistor $M_7$ and Mg as a current mirror to create the required sinking current In from node 322 or 332. Thus, circuit 300 may be completely self-biased by its feedback loop.

In circuit 300, the current ratios of Ip to Ix or In to Ix may be chosen according to the desired collector current from transistor 320 or 330. As an example, for β of 0.5 and a targeted value for collector current Ic, one may choose Ip:Ix=3 and In:Ix=2, so that Ix is equal to Ic.

In some embodiments, a bandgap less than 1.0V may be created, e.g., if only a fraction of the base-emitter voltage is used for Vref. This allows operation of the circuit with supply less than 1.0V, which is often required for FinFet technologies. As an example, a simple resistive divider may be connected in parallel to the base-emitter of transistor 320 or 330, and Vref may be tapped in the middle.

In various embodiments, circuit 300 may compensate for the influence of current gain by providing feedback around the base-emitter terminals. Thus, circuit 300 may provide a reference voltage that is stable even for very low bipolar gain (e.g., β<1). For other bandgap circuits, their bipolar transistors may be similarly modified according to the β-compensation scheme as discussed in connection with FIG. 3 or FIG. 4, so that a stable reference voltage may also be obtained even with very low β.

Figure 4:
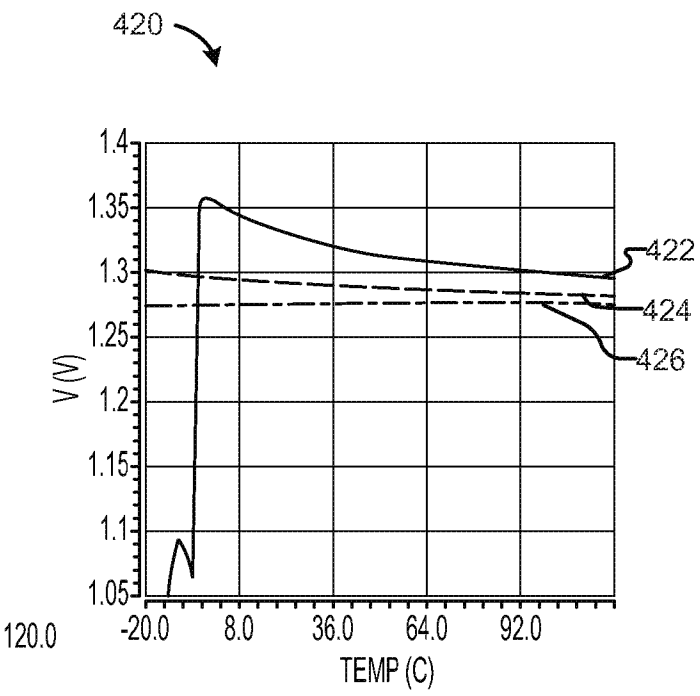
FIG. 4 is a set of plots showing outputs from various bandgap voltage reference circuits.
Figure 4:
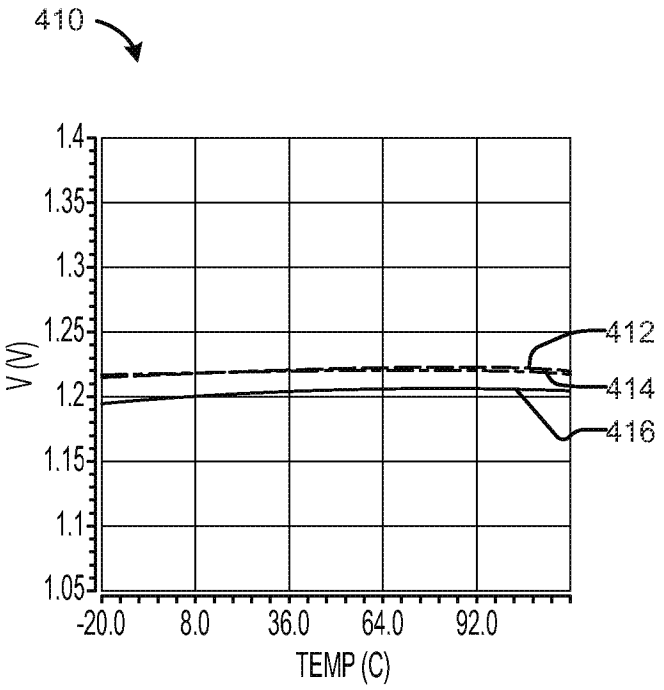

FIG. 4 is a set of plots showing outputs from various bandgap voltage reference circuits. Plot 410 shows example Vref outputs versus temperature using a bandgap circuit with β-compensation enhanced by the present disclosure, while plot 420 shows example Vref outputs with a traditional bandgap circuit.

In plot 410, line 412 represents the Vref output with β at 3.1, line 414 represents the Vref output with β at 1.5, and line 416 represents the Vref output with β at 0.7. Similarly, in plot 420, line 422 represents the Vref output with β at 0.7, line 424 represents the Vref output with β at 1.5, and line 426 represents the Vref output with β at 3.1.

As shown, with the traditional bandgap circuit, a low β at 0.7 largely distorted the Vref output line, and a stable Vref may not be obtained. On the contrary, even with a low β at 0.7, the bandgap circuit with β-compensation may still produce an accurate Vref output. Therefore, such bandgap circuits with β-compensation may achieve a more stable output even for very low β values.

Figure 5:
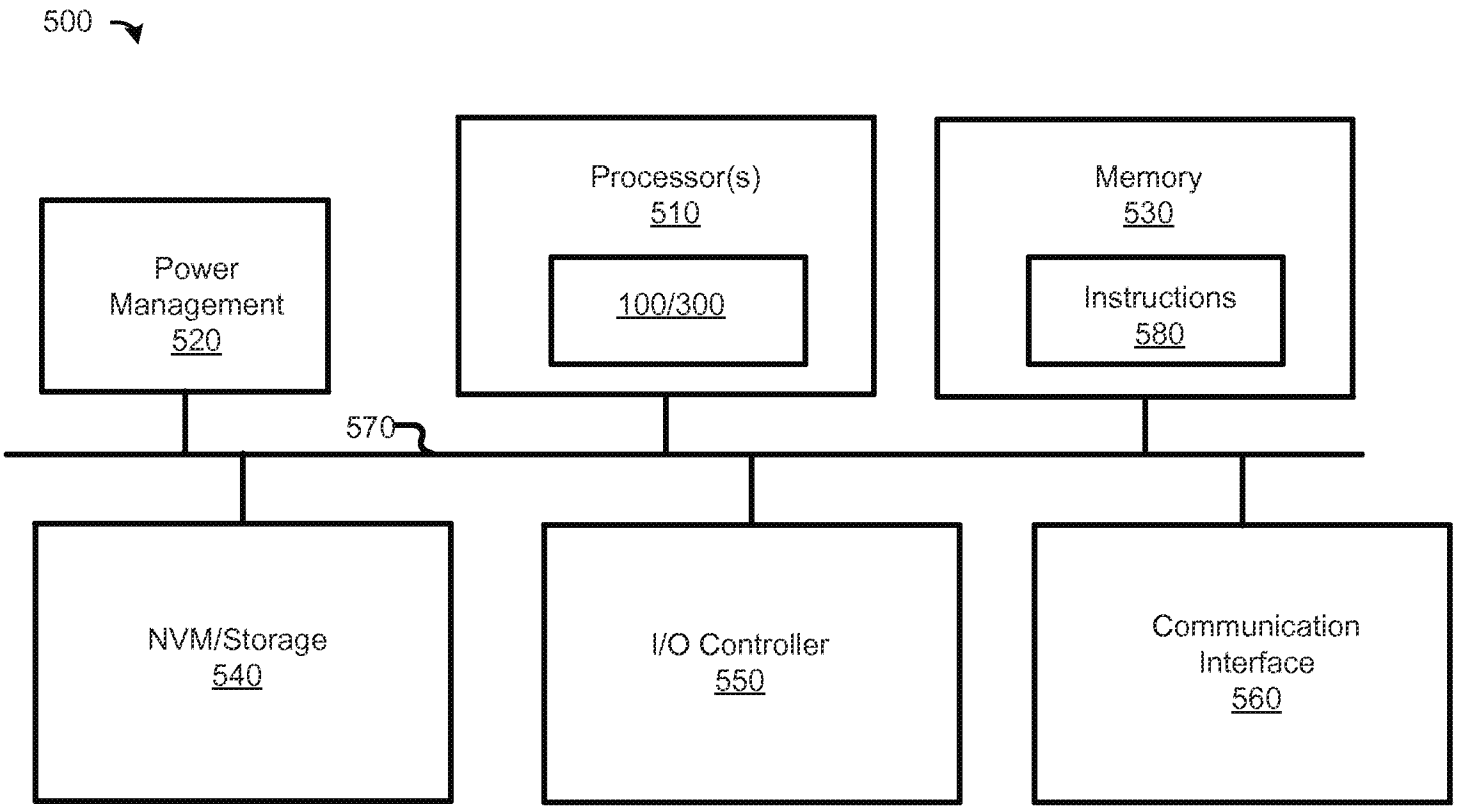
FIG. 5 is a block diagram that illustrates an example computer device suitable for practicing the disclosed embodiments, in accordance with various embodiments.

FIG. 5 is a block diagram that illustrates an example computer system 500 suitable for practicing the disclosed embodiments with any of the design principles described with reference to FIGS. 1-3, in accordance with various embodiments. In one embodiment, computing system 500 represents a mobile computing device, such as a computing tablet, a mobile phone or smartphone, a wireless-enabled e-reader, or another wireless mobile device. It will be understood that certain components are shown generally, and not all components of such a device are shown in computing system 500.

As shown, computer system 500 may include a power management 520; a number of processors or processor cores 510 having at least one circuit for current regulation, like circuit 100; a system memory 530 having processor-readable and processor-executable instructions 580 stored therein; a non-volatile memory (NVM)/storage 540; an I/O controller 550; and a communication interface 560. For the purpose of this application, including the claims, the terms "processor" and "processor cores" may be considered synonymous, unless the context clearly requires otherwise. Those elements of FIG. 5 having the same reference numbers (or names) as the elements of any other figure can operate or function in any manner similar to that described, but are not limited to such.

In one embodiment, processors 510 may include one or more physical devices, such as microprocessors, application processors, microcontrollers, programmable logic devices, or other processing means. In various embodiments, processors 510 may include circuits like circuit 100 in connection with FIG. 1 or circuit 300 in connection with FIG. 3. Therefore, an accurate bandgap reference may be obtained even with large beta-variation and/or low current gain. The processing operations performed by processors 510 may include the execution of an operating platform or operating system on which applications and/or device functions are executed. The processing operations may include operations related to input/output (I/O) with a human user or with other devices, operations related to power management, and/or operations related to connecting the computing system 500 to another device. The processing operations may also include operations related to audio I/O and/or display I/O.

The one or more NVM/storage 540 and/or the system memory 530 may comprise a tangible, non-transitory computer-readable storage device (such as a diskette, hard drive, compact disc read only memory (CD-ROM), hardware storage unit, flash memory, phase change memory (PCM), solid-state drive (SSD) memory, and so forth). Instructions 580 stored in system memory 530 and/or NVM/storage 540 may be executable by one or more of the processors 510. Instructions 580 may contain particular instructions of an operating system and one or more applications.

Computer system 500 may also include input/output devices (not shown) coupled to computer system 500 via I/O controller 550. I/O controller 550 illustrates a connection point for additional devices that connect to computing system 500 through which a user might interact with the system. For example, various devices that may be coupled to the computer system 500 via I/O controller 550 may include microphone devices, speaker or stereo systems, video systems or other display devices, keyboard or keypad devices, or other I/O devices for use with specific applications such as card readers or other devices. In various embodiments, I/O controller 550 may include a device to provide a temperature-stabilized reference voltage to peripherals, such as a digital camera. In various embodiments, I/O controller 550 may include circuits like circuit 100 in connection with FIG. 1 or circuit 300 in connection with FIG. 3 to provide voltage reference independent of the current gain of a bipolar device in the device.

In embodiments, communication interface 560 may provide an interface for computing system 500 to communicate over one or more network(s) and/or with any other suitable device. Communication interface 560 may include any suitable hardware and/or firmware, such as a network adapter, one or more antennas, wireless interface(s), and so forth. In various embodiments, communication interface 560 may include an interface for computing system 500 to use near field communication (NFC), optical communications, or other similar technologies to communicate directly (e.g., without an intermediary) with another device. In various embodiments, communication interface 560 may interoperate with radio communications technologies such as, for example, Wideband Code Division Multiple Access (WCDMA), Global System for Mobile Communications (GSM), Long Term Evolution (LTE), WiFi, Bluetooth®, Zigbee, and the like. In various embodiments, communication interface 560 may include circuits like circuit 100 in connection with FIG. 1 or circuit 300 in connection with FIG. 3.

The various elements of FIG. 5 may be coupled to each other via a system bus 570, which represents one or more buses. In the case of multiple buses, they may be bridged by one or more bus bridges (not shown). Data may pass through the system bus 570 through the I/O controller 550, for example, between an output terminal and the processors 510.

System memory 530 and NVM/storage 540 may be employed to store a working copy and a permanent copy of the programming instructions implementing one or more operating systems, firmware modules or drivers, applications, and so forth, herein collectively denoted as instructions 580. In embodiments, instructions 580 may include logic for regulating the collector current from a bipolar device and/or generating bandgap reference described in this disclosure. The permanent copy of the programming instructions may be placed into permanent storage in the factory, or in the field, via, for example, a distribution medium (not shown), such as a compact disc (CD), or through the communication interface 560 (from a distribution server (not shown)).

In some embodiments, at least one of the processor(s) 510 may be packaged together with I/O controller 550 to form a System in Package (SiP). In some embodiments, at least one of the processor(s) 510 may be integrated on the same die with I/O controller 550. In some embodiments, at least one of the processor(s) 510 may be integrated on the same die with I/O controller 550 to form a System on Chip.

In various embodiments, computing system 500 may need reference voltages, to define control voltages within power management 520, processor(s) 510, memory 630, I/O controller 650, and so on. In various embodiments, computing system 500 may also comprise thermal sensors, e.g., in power management 620 and so on. In these embodiments, computing system 500 may include a bipolar device, e.g., in circuits like circuit 100 in connection with FIG. 1 or circuit 300 in connection with FIG. 3, to achieve precision output, e.g., independent of the current gain of the bipolar device in the device.

According to various embodiments, one or more of the depicted components of the system 500 and/or other element(s) may include a keyboard, LCD screen, non-volatile memory port, multiple antennas, graphics processor, application processor, speakers, or other associated mobile device elements, including a camera. The remaining constitution of the various elements of the computer system 500 is known, and accordingly will not be further described in detail.

The above description of illustrated embodiments, including what is described in the Abstract, is not intended to be exhaustive or to be limited to the precise forms disclosed. While specific embodiments and examples are described herein for illustrative purposes, various modifications are possible. For example, the configuration and connection of certain elements in various embodiments that have been described above may be modified without departing from the teachings in connection with FIGS. 1-5. These and other modifications can be made in light of the above detailed description. The terms used in the following claims should not be construed to be limited to the specific embodiments disclosed in the specification.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is always only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications, and variations of such embodiments will be apparent to those of ordinary skill in the art in light of the foregoing description. The embodiments of the disclosure are intended to embrace all such alternatives, modifications, and variations as to fall within the broad scope of the appended claims.

In addition, well-known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to the implementation of such block diagram arrangements are highly dependent upon the platform within which the present disclosure is to be implemented (i.e., such specifics should be well within the purview of one skilled in the art). Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

The following examples pertain to further embodiments. Specifics in the examples may be used anywhere in one or more embodiments. All optional features of the apparatus described herein may also be implemented with respect to a method or process.

Example 1 is a circuit for generating a temperature-stabilized reference voltage on a semiconductor chip. The circuit may include a differential amplifier comprising a first input, a second input, and an output. The circuit may include a first bipolar junction transistor (BJT) coupled to the first input and a second BJT coupled to the second input. The circuit may further include beta compensation circuitry, coupled to the first BJT and the second BJT, to regulate a first collector current of the first BJT to be independent of a first current gain of the first BJT and a second collector current of the second BJT to be independent of a second current gain of the second BJT.

Example 2 may include the subject matter of Example 1, and may further specify that the differential amplifier is to keep a first potential at a first emitter of the first BJT at a same level as a second potential at a second emitter of the second BJT.

Example 3 may include the subject matter of Example 1 or 2, and may further specify that the first and second BJTs have different current densities.

Example 4 may include any subject matter of Examples 1-3, and may further specify that the beta compensation circuitry comprises a first resistor, coupled to a base of the first BJT, to control a clamping function at the base of the first BJT.

Example 5 may include the subject matter of Example 4, and may further specify that the beta compensation circuitry is to make a first voltage difference between a base voltage and an emitter voltage of the first BJT, and a second voltage difference between a base voltage and an emitter voltage of the second BJT, equal to a voltage drop over the first resister.

Example 6 may include the subject matter of Example 4 or 5, and may further specify that the beta compensation circuitry comprises a second resistor, coupled to the first resistor, to scale a bandgap reference voltage of the circuit established at an emitter of the first BJT or the second BJT.

Example 7 may include any subject matter of Examples 1-3, and may further specify that the beta compensation circuitry comprises a first transistor, coupled to a first emitter and a first base of the first BJT, to form a first feedback loop between the first emitter and the first base of the first BJT, wherein the first feedback loop is to provide a first corrective current to the first emitter based at least in part on a first base current from the first base; and a second transistor, coupled to a second emitter and a second base of the second BJT, to form a second feedback loop between the second emitter and the second base of the second BJT, wherein the second feedback loop is to provide a second corrective current to the second emitter based at least in part on a second base current from the second base.

Example 8 may include any subject matter of Examples 1-7, and may further specify that the beta compensation circuitry is to establish a bandgap reference voltage with a zero temperature coefficient based on a voltage at an emitter of the first BJT or the second BJT.

Example 9 is a circuit for current regulation. The circuit may include a bipolar junction transistor (BJT) having an emitter coupled to a first fixed current source to supply a first current to the BJT, a base coupled to a second fixed current source to supply a second current to the BJT, and a collector to output a collector current. The BJT has a current gain based on the collector current and a base current from the base. The circuit may further include a feedback loop, coupled to the emitter and the base, to regulate the collector current independent of the current gain.

Example 10 may include the subject matter of Example 9, and may further specify that the feedback loop comprises a first node and a second node on a path from the first fixed current source to the second fixed current source, wherein the first node splits the first current onto a first path and a second path, and wherein the first path and the second path merge into the second node.

Example 11 may include the subject matter of Example 10, and may further specify that the feedback loop is to regulate a sum of currents merged at the second node from the first path and the second path to be equal to the second current.

Example 12 may include the subject matter of Example 10 or 11, and may further specify that the feedback loop comprises a separating device located on the second path from the first node to the second node.

Example 13 may include the subject matter of Example 12, and may further specify that the separating device is an N-type metal-oxide-semiconductor field-effect transistor.

Example 14 may include any subject matter of Examples 9-13, and may further specify that the feedback loop is to regulate the collector current to be equal to a difference between the first current and the second current.

Example 15 may include any subject matter of Examples 9-14, and may further specify that the feedback loop is to regulate the collector current to be independent of a variance of the base current from the base.

Example 16 is a method for current regulation, which may include sensing a base current from a base of a bipolar device; applying a corrective current to an emitter of the bipolar device, based at least in part on the sensed base current; and providing a collector current from a collector of the bipolar device independent of a current gain of the bipolar device.

Example 17 may include the subject matter of Example 16, and may further include supplying first and second fixed currents to a feedback loop between the emitter and the base; and producing the collector current to be equal to a difference between the first and second fixed currents.

Example 18 may include the subject matter of Example 16 or 17, and may further include splitting the first fixed current onto a first path and a second path of the feedback loop, wherein the first path includes the emitter and the second path includes the base; adjusting a current on the second path based on the sensed base current and the second fixed current; and applying the corrective current to the emitter based on the current on the second path and the first fixed current.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

I claim:

1. A circuit, comprising:

a differential amplifier comprising a first input, a second input, and an output;

a first bipolar junction transistor (BJT) coupled to the first input;

a second BJT coupled to the second input; and beta compensation circuitry, coupled to the first BJT and the second BJT, to regulate a first collector current of the first BJT to be independent of a first current gain of the first BJT and a second collector current of the second BJT to be independent of a second current gain of the second BJT, wherein the beta compensation circuitry comprises:

a first transistor, coupled to a first emitter and a first base of the first BJT, to form a first feedback loop between the first emitter and the first base of the first BJT, wherein the first feedback loop is to provide a first corrective current to the first emitter based at least in part on a first base current from the first base; and a second transistor, coupled to a second emitter and a second base of the second BJT, to form a second feedback loop between the second emitter and the second base of the second BJT, wherein the second feedback loop is to provide a second corrective current to the second emitter based at least in part on a second base current from the second base.

2. The circuit of claim 1, wherein the differential amplifier is to keep a first potential at the first emitter of the first BJT at a same level as a second potential at the second emitter of the second BJT.

3. The circuit of claim 1, wherein the first and second BJTs have different current densities.

4. The circuit of claim 1, wherein the beta compensation circuitry comprises a first resistor, coupled to the first base of the first BJT, to control a clamping function at the first base of the first BJT.

5. The circuit of claim 4, wherein the beta compensation circuitry is to make a first voltage difference between a base voltage and an emitter voltage of the first BJT, and a second voltage difference between a base voltage and an emitter voltage of the second BJT, equal to a voltage drop over the first resister.

6. The circuit of claim 4, wherein the beta compensation circuitry comprises a second resistor, coupled to the first resistor, to scale a bandgap reference voltage of the circuit established at the first emitter of the first BJT or the second emitter of the second BJT.

7. The circuit of claim 1, wherein the beta compensation circuitry is to establish a bandgap reference voltage with a zero temperature coefficient based on a voltage at the first emitter of the first BJT or the second emitter of the second BJT.

8. A circuit, comprising:

a bipolar junction transistor (BJT) having an emitter coupled to a first fixed current source to supply a first current to the BJT, a base coupled to a second fixed current source to supply a second current to the BJT, and a collector to output a collector current, wherein the BJT has a current gain based on the collector current and a base current from the base; and a feedback loop, coupled to the emitter and the base, to regulate the collector current independent of the current gain.

9. The circuit of claim 8, wherein the feedback loop comprises a first node and a second node on a path from the first fixed current source to the second fixed current source, wherein the first node splits the first current onto a first path and a second path, and wherein the first path and the second path merge into the second node.

10. The circuit of claim 9, wherein the feedback loop is to regulate a sum of currents merged at the second node from the first path and the second path to be equal to the second current.

11. The circuit of claim 9, wherein the feedback loop comprises a separating device located on the second path from the first node to the second node.

12. The circuit of claim 11, wherein the separating device is an N-type metal-oxide-semiconductor field-effect transistor.

13. The circuit of claim 8, wherein the feedback loop is to regulate the collector current to be equal to a difference between the first current and the second current.

14. The circuit of claim 8, wherein the feedback loop is to regulate the collector current to be independent of a variance of the base current from the base.

15. A method, comprising:

sensing a base current from a base of a bipolar junction transistor (BJT);

applying a corrective current to an emitter of the BJT, based at least in part on the sensed base current;

supplying first and second fixed currents to a feedback loop between the emitter and the base;

providing a collector current from a collector of the BJT independent of a current gain of the BJT, the collector current equal to a difference between the first and second fixed currents.

16. The method of claim 15, further comprising:

splitting the first fixed current onto a first path and a second path of the feedback loop, wherein the first path includes the emitter and the second path includes the base;

adjusting a current on the second path based on the sensed base current and the second fixed current; and applying the corrective current to the emitter based on the current on the second path and the first fixed current.

* * * * *